United States Patent [19]

Fischer

[11] 4,414,896

[45] Nov. 15, 1983

[54] SHEET-FED ROTARY PRIME AND VERSO OFFSET PRINTING MACHINE & METHOD

[75] Inventor: Hermann Fischer, Augsburg, Fed. Rep. of Germany

[73] Assignee: M.A.N.-ROLAND Druckmaschinen Aktiengesellschaft, Offenbach am Main, Fed. Rep. of Germany

[21] Appl. No.: 353,235

[22] Filed: Mar. 1, 1982

[30] Foreign Application Priority Data

Mar. 7, 1981 [DE] Fed. Rep. of Germany ..... 3108807

[51] Int. Cl.[3] ..... B41M 1/14; B41F 5/16

[52] U.S. Cl. ..... 101/211; 101/184; 101/230; 101/231; 271/107; 271/108

[58] Field of Search ..... 101/184, 183, 230–232, 101/211; 271/107, 108, 231

[56] References Cited

U.S. PATENT DOCUMENTS

| | | | |
|---|---|---|---|
| 2,940,387 | 6/1960 | Pritchard | 101/183 |
| 3,294,396 | 12/1966 | Staines | 271/108 X |
| 3,785,287 | 1/1974 | Dahlgren | 101/184 |
| 3,800,698 | 4/1974 | Kist et al. | 101/184 |
| 3,829,085 | 8/1974 | Jeschke et al. | 271/108 X |
| 3,884,146 | 5/1975 | Ruetschle | 101/183 |
| 3,916,790 | 11/1975 | Alix | 271/108 X |
| 3,934,868 | 1/1976 | Selak | 271/108 |
| 3,946,669 | 3/1976 | Johne et al. | 101/183 X |
| 4,218,272 | 8/1980 | Fujishiro | 101/184 |
| 4,369,705 | 1/1983 | Gelinas | 101/182 X |

FOREIGN PATENT DOCUMENTS

| | | | |
|---|---|---|---|
| 137829 | 9/1979 | U.S.S.R. | 101/182 |

*Primary Examiner*—E. H. Eickholt

*Attorney, Agent, or Firm*—Frishauf, Holtz, Goodman & Woodward

[57] ABSTRACT

To permit, selectively, multi color prime printing or prime-and-verso printing, two rubber blanket cylinders (5, 6) each in engagement with a respective cylinder (3, 4) cooperate with a single printing or impression cylinder (7), and an engagement element (23, 24, 28) such as a roller (23, 24) or a compressed air supply (28); the rubber cylinder can be engaged with the impression cylinder or, respectively, separated therefrom. The impression cylinder carries a rubber blanket to receive printing information from one (5) of the blanket cylinders to effect verso printing during one operation phase, when the engagement element controls engagement of a sheet about the impression cylinder the other rubber blanket cylinder being engaged when the sheet reaches the printing line for verso printing; during a subsequent operation phase of the machine, the second rubber blanket cylinder (6) is separated from the impression cylinder to prevent smearing contact therewith, while the first rubber blanket cylinder (5) transfers printing information from its associated plate cylinder (3) to the rubber blanket on the impression cylinder. The sheet feed mechanism feeds a sheet only for every alternate operating phase. In normal operation, with a sheet fed for each revolution, the impression cylinder receives no ink and multi color prime printing can be effected by the two rubber blanket cylinders (5, 6). Double inking can be obtained by selectively lifting off both rubber blanket cylinders for alternate revolutions and feeding a sheet, only for every other revolution of the printing system, with, then, both rubber blanket cylinders engaging the sheet looped about the impression cylinder.

17 Claims, 9 Drawing Figures

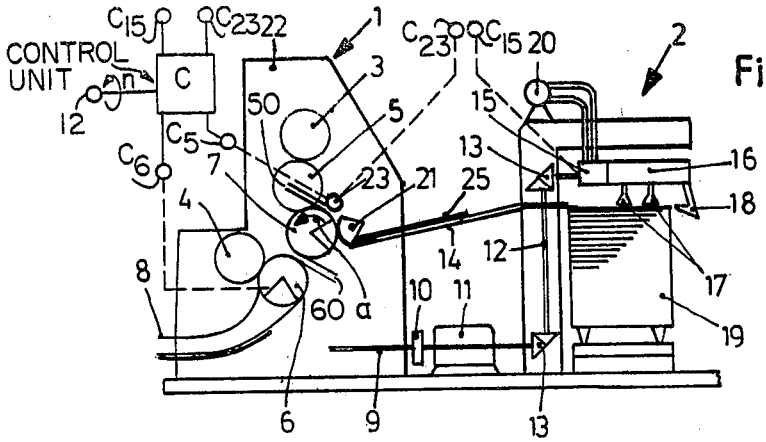
Fig.1
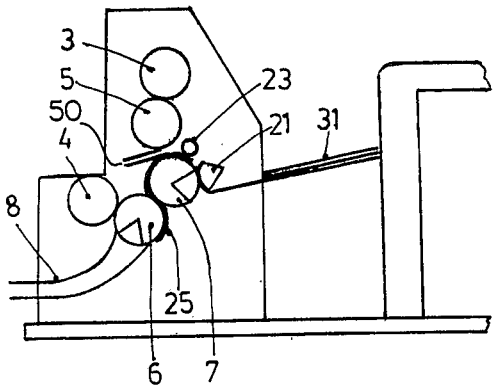
Fig.2
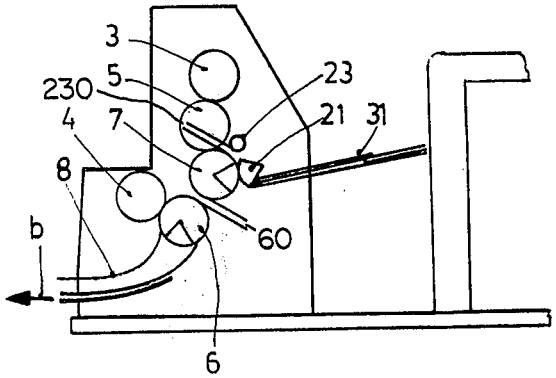
Fig.3
Fig.6
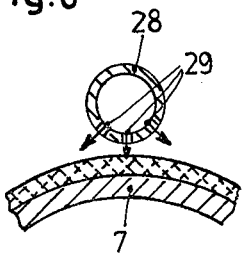
Fig.5
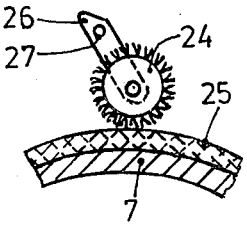
Fig.4
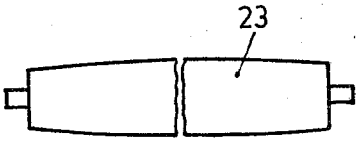

SHEET-FED ROTARY PRIME AND VERSO OFFSET PRINTING MACHINE & METHOD

The present invention relates to a sheet-fed rotary offset printing machine system and more particularly to a system which is versatile and can be changed over for selective operation to provide, either multi-color prime printing or prime and verso printing, and especially to such systems which are compatible with existing printing machines so that existing machines can be changed over to permit, selectively, either of the operating modes without substantial rebuilding.

BACKGROUND

One printing machine of the type to which the present invention relates has been described in "Technisches Jahrbuch für den Offsetdrucke," 1979, pp. 24 and 25, published by ROLAND Offsetmaschinenfabrik Faber & Schleicher AG, Offenbach, Fed. Rep. Germany ("Technical Yearbook for the Offset Printer"). As there shown, two printing stations have a sheet supplied thereto with a sheet reversing system interposed. The sheet reversing system is so constructed that the leading edge of a sheet is held by grippers which are secured to a chain, and guided past an adjacent drum so that the trailing edge can be gripped by the drum. After opening of the grippers on the leading edge, the previously trailing edge then becomes the leading edge and is carried in that position to the next printing station. Adjusting such a printing machine for prime and verso printing requires more time than setting-up such a machine for prime printing only. Additional apparatus must be provided to prevent excessive scrap production, such as use of compressed air, air nozzles, or suction air at suitable locations, since the sheets tend to smear as they are being turned or reversed. Further, each one of the sheets must have a strip which is free from print not only along the leading edge but also along the trailing edge. The trailing edge strip must match that of the leading edge since, after reversal, that one becomes the leading edge, on which grippers must be capable of holding the sheet. The format of the sheet is not as efficiently used in prime and verso printing as when only single side multiple color printing is applied thereto.

Printing machines arranged for prime and verso printing are also disclosed in the book by Walenski, "Einführung in de Offsetdruck," p. 155 ("Introduction to Offset Printing"). The sheet is printed on both sides by being passed between two rubber blanket cylinders. Such machines can also be used, basically, for single-side single-color printing. This requires disconnection of one of the printing systems including the associated inker and damper. If the proportion of the prime-and-verso printing jobs is small in relation to the printing jobs requiring only prime printing, then such a machine is not utilized effectively during a large portion of its operating time.

THE INVENTION

It is an object to provide a printing machine which permits prime printing in more than one color or, selectively, prime and verso printing, which can be easily changed over between the printing modes, and which is efficient in paper format utilization; and, further, in which existing printing machines can be utilized to carry out different printing modes.

Briefly, a selector is provided coupled to and selectively controlling the speed of sheet delivery apparatus in two different speed ranges to supply sheets at the first, predetermined rate for single-sided prime printing and at half said rate for prime and verso printing. An engagement element, such as a roller, or a brush element which may have compressed air nozzles and the like therein, is positioned between the sheet supply apparatus and the printing or impression cylinder, in order to, selectively, press a sheet against the printing or impression cylinder. The printing or impression cylinder has a rubber blanket on its surface so that, in one mode of operation, the rubber blanket cylinder of the offset machine transfers printing information to the printing or impression cylinder by engagement therewith when no sheet is fed between the cylinders. During a subsequent operating phase, the rubber blanket cylinder is separated from the printing or impression cylinder and a sheet passed over the printing or impression cylinder, being engaged therewith by the engagement element, such as the aforementioned roller or brush. Engagement and disengagement of the respective cylinders is controlled by a control unit which positions the respective cylinders, preferably the rubber blanket cylinders, by rocking their axes of rotation in an arcuate path about the center of rotation of the associated plate cylinder so that contact with the plate cylinder is continuously maintained. The movement can be controlled by an eccenter, for example mechanically or hydraulically rocked, by pivoting levers, or the like.

The system has the advantage that selective changeover between prime or prime-and-verso printing is readily possible, and existing machines can be retrofitted to thereby become more versatile; in new machine constructions, the basic structural arrangement of existing machines can be maintained, thus simplifying stocking of parts, and machining operations.

DRAWINGS

FIG. 1 is a schematic side view of the rotary offset printing machine embodying the present invention;

FIGS. 2 and 3 are fragmentary side views of the machine of FIG. 1 and illustrating the position of respective cylinders thereof at different instants of time.

FIG. 4 is a side view of one form of engagement roller;

FIG. 5 is a schematic end view of another form of engagement roller, applied to the printing or impression cylinder;

FIG. 6 is a part sectional view through an engagement element positioned adjacent the printing or impression roller;

Figure 7:
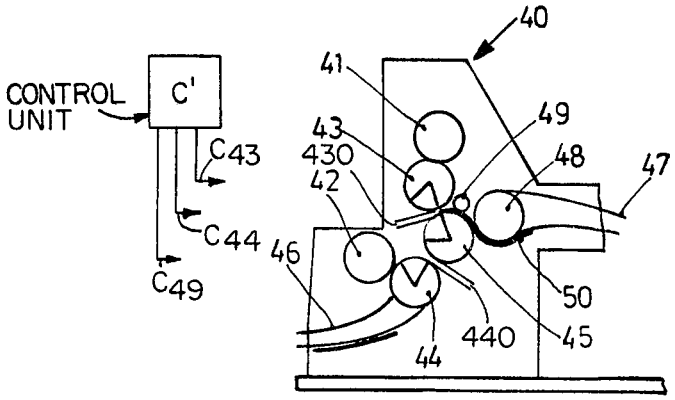
Figure 8:
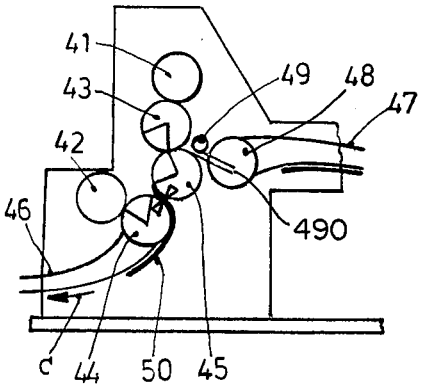
Figure 9:
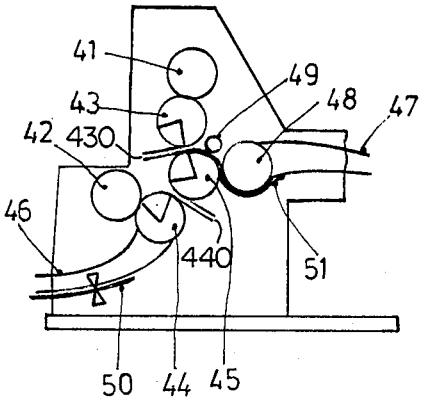

FIG. 7 is a schematic side view of a printing machine illustrating another embodiment; and FIGS. 8 and 9 show the machine of FIG. 7 at different instants of time in their operating cycle, in which the positions shown in FIGS. 8 and 9 correspond to those shown in FIGS. 2 and 3 with respect to the embodiment of FIG. 1.

The sheet fed rotary offset printing machine has two superposed printing systems. The machine 1 cooperates with a sheet supply apparatus 2. The two printing systems, each, have a plate cylinder 3, 4 and a rubber cylinder 5, 6. Both printing cylinders work together with a single printing or impression cylinder 7. All the cylinders have the same diameter. The printing or impression cylinder 7 has a rubber blanket thereover capable of accepting printed information. A sprocket wheel, not specifically shown, is positioned at the two respective facing ends of the blanket cylinder 6, the sprocket wheel guiding a chain 8. Chain 8 has grippers to grip the sheet. The grippers, which may be of any suitable construction, are not shown for simplicity of the drawing. Likewise, inking systems and damping systems associated with the plate cylinders 3, 4 and which may be of any suitable construction, are not further shown.

The blanket cylinders 5, 6 are journaled in the side walls 22 of the printing machine 1. The bearings journaling the cylinders 5, 6 are movable in the side walls 22, in an arcuate path so that upon movement of the blanket cylinders, contact with the plate cylinders is always maintained. A suitable positioning structure is an eccentric arrangement, operated, for example, by hydraulic pistoncylinder positioning apparatus, as well known. Other positioning elements may be used. The positioning of the centers of rotation of the blanket cylinder 5, 6 is controlled by an electrical or mechanical control system which, at a desired instant of time causes positioning movement between, for example, an engaged and a disengaged or idle, or freewheeling position with respect to the associated impression cylinder. The control system may be electrical, or mechanical, a suitable electrical system being a timing system which receives input from the drive shaft of the machine, for synchronization, and provide suitable control output signals, for example, to electromagnetic valves to control hydraulic fluid for a hydraulic positioning system. A mechanical operating system may, for example, use a cam and cam followers which directly control positioning of the blanket cylinders or which control suitable valves.

Positioning elements for the centers of rotation of cylinders have been used in the past to control introduction of the first sheet of a sheet fed machine into a printing machine and subsequent positioning of the blanket cylinder at the impression or printing line in dependence of feed of the sheet to the printing line.

In accordance with the present invention, the control system is so modified or expanded that it can carry out additional functions, to be described below.

The sheet feeding apparatus 2 is driven from a main drive shaft 9 which is supplied with rotary power over a belt drive 10 coupled to an electric motor 11. The drive shaft 9 is connected over bevel gear 13 with a power drive train 12. The power drive train 12 provides rotary power for transport belts of a make-ready table 14 and additionally it is connected to a control box 15 of a sheet lifting and supply apparatus 16 which reciprocates back and forth. The supply apparatus 16 has suction grippers 17 and air blast nozzles 18. The sheet lifting device 16 moves the suction grippers 17 in reciprocating movement which picks up the uppermost sheet from a stack of sheets 19 and supplies that sheet to the make-ready table 14. The control box 15 receives suction and compressed air ducts from a pump 20, and so controls application of suction, or compressed air to the suction cup 17 and nozzle 18 respectively, that, when the printed machine is controlled for prime printing only, in the case of the present machine for dual color prime printing, the suction grippers 17 are connected to the suction source for each reciprocating movement. Consequently, a sheet is fed from the stack 19 to the make-ready table 14 upon each reciprocating of the suction cup 17. Similarly, the air blow nozzles 18 have compressed air applied thereto when the suction cups 17 are connected to the vacuum source. In another mode of operation, however, the suction grippers and the nozzles have vacuum and compressed air, respectively, applied only for every other reciprocating movement of the suction cups 17. Thus, and with respect to machine speed, only half the number of sheets will be lifted from the stack 19 and applied to the machine than the number which is supplied upon lifting of a sheet during each reciprocation. The lower feed rate is used when the machine is adjusted for both prime and verso printing. In this mode of operation, then, only half the number of sheets per unit time will be printed by the machine. The sheets are transferred from the make-ready table 14 to the impression cylinder 7 by a gripper set 21.

The impression cylinder 7 rotates in the direction shown by the arrow a. Positioned shortly behind the transfer grippers 21, with respect to the direction of rotation as indicated by arrow a, a device is provided to apply, or engage a sheet on the circumference of the printing or impression cylinder 7. This engagement device may take various forms, see FIGS. 4, 5, 6.

As illustrated in FIG. 4, the engagement device is a pressure roller 23. Preferably, the pressure roller 23 has a slightly larger diameter in the center thereof than at the ends in order to compensate for bend-through of the pressure roller 23. With respect to the length of the impression cylinder, the engagement force applied by the pressure roller thus will be essentially uniform.

Rather than using a pressure roller with a solid jacket or surface, a brush roller 24 may be used; See FIG. 5. The brush roller 24 engages a sheet 25 against the surface of the impression cylinder 7. The engagement roller 25, or the brush roller 24, is movably journaled in the side walls 22 of the printing system 1 so that it can be, selectively, engaged with the impression cylinder 7 or separaed therefrom, for example by being lifted off the surface of the impression cylinder 7. The shaft of the roller 23, or the roller 24, respectively, is secured at its end in a pivot lever 26 which is pivotable about the pin 27 secured to the sidewall 22. The roller 23, or brush roller 24, could, however, also be retained in eccentric bearings. Engaging or disengaging movement of the roller 23, 24, respectively, is controlled by the control unit such that the roller 23, 24, respectively, during a sheet passage phase is pressed against the impression cylinder 7, but separated therefrom during a subsequent idling or non-printing phase. Control of the respective roller 23, 24 is effected by the same control unit which provides for shifting of the position of the shafts, or centers of rotation of the blanket cylinders 4, 5.

The rollers 23, 24 preferably are driven at the surface speed which is somewhat smaller than the circumferential speed of the impression cylinder 7. This provides for smooth fitting of the sheet 25 on the impression cylinder without creases or folds.

Rather than using a roller 23 or 24, respectively, a compresssed air supply tube 28 (FIG. 6) may be provided, positioned adjacent the impression cylinder 7 and extending parallel to its axis of rotation. The compressed air supply tube 28 has exit openings or nozzles 29, directed toward cylinder 7. To prevent wasting compressed air, supply of compressed air to the tube 28 is, preferably, so controlled that compressed air is supplied only during the sheet passage phase, and no compressed air is being supplied during the subsequent idling phase.

The impression cylinder 7 has a rubber blanket applied thereto suitable for transfer of ink carrying printed information.

A control unit C is provided, coupled to the positioning elements of the respective cylinders, and receiving input information regarding the circumferential, or rotary position of the respective cylinders being coupled to the drive train 12, as schematically indicated in FIG. 1, that is, receiving rotary information as shown by arrow n. The control unit C provides positioning outputs at respective output positions C5, C6 to control the position of blanket cylinders 5, 6; and output points C15, C23 coupled, respectively, to the application device 23—which, of course, may take the form of the roller 23 or of the brush roller 24 (FIG. 5) or of the compressed air tube 28 (FIG. 6) and to the pneumatic control box 15 to provide for time-synchronized operation of all the components of the machine.

OPERATION

Let it be assumed that the base position of the elements is shown as in FIG. 1. Upon rotation of the impression cylinder 7 in the direction of the arrow a, a sheet 25 will be supplied from the supply grippers 21 after a short rotary distance. The impression cylinder 7 has a set of grippers located in a groove, only schematically indicated by V-lines extending towards the circumference of the impression cylinder 7. As soon as the impression cylinder 7 has transported the sheet 25 to the gap adjacent the application elements 23, 24, 28, respectively, the sheet 25 is engaged with the impression cylinder, for example by movement of the rollers 23, 24, or application of compressed air to the tube 28. At that instant of time, the impression cylinder 7 still is in contact with the blanket cylinder 5, to receive printed image from the blanket cylinder 5. Upon further rotation, and as the leading edge of the sheet 25 approaches the contact line with the blanket cylinder 5, the control unit C controls the blanket cylinder 5 to separate from engagement with the impression cylinder 7 so that a separating gap 50 will occur during the sheet passage phase. No ink will be supplied from the rubber blanket cylinder 5 to the sheet 25 engaged on the impression cylinder. During the rotation of the impression cylinder 7, a space schematically indicated by gap lines 60 is maintained between the blanket cylinder 6 and the impression cylinder 7. The gap between the blanket cylinder 5 and the impression cylinder 7 is shown by gap lines 50, FIG. 2, the reference numeral having been omitted from FIG. 1 for purposes of clarity of the drawing.

As the leading edge of the sheet 25 reaches the gap between the impression cylinder 7 and the blanket cylinder 6, blanket cylinder 6 is engaged against the impression cylinder 7 to apply printing information thereto at the side reversed with respect to the information applied by the impression cylinder 7. Upon continued rotation, the grippers (not shown) on chain 8 receive the sheet 25. Both prime as well as verso printing will occur between the cylinders 6, 7 simultaneously. FIG. 2 illustrates the positions of the components of the machine after rotation of the cylinders about 360 degrees. As can be seen, the blanket cylinder 6 and the impression cylinder 7 are in engagement with each other, that is, the gap or separation 60 has been removed by repositioning the blanket cylinder 6. A gap 50 is maintained between the blanket cylinder 5 and the impression cylinder 7. The application roller 23 is in engagement with the impression cylinder 7 so long as a sheet remains on the circumference of the impression cylinder 7. At the instant of time when the end of the sheet is passed by the engagement roller 23, the roller is lifted off the engagement cylinder 7 to define a gap 230 (FIG. 3) therewith. FIG. 3 further shows that the gripper unit 21 on the make-ready table after one rotation of the cylinder 360 makes one supply movement without, however, feeding a sheet, that is, makes an idle movement since no new sheet has been applied to the make-ready table by the suction grippers 17.

Upon further rotation of the cylinders, the sheet 25 is removed by the chain 8 in the direction of the arrow (FIG. 3) to a sheet delivery station. The sheets could however, also be supplied to a further dual printing apparatus. As soon as the trailing end of sheet 25 leaves the gap between the impression cylinder 7 and the rubber blanket cylinder 5, rubber blanket cylinder 5 is again engaged with the impression cylinder 7 so that a new printing image can be transferred thereto. When, thereafter, the trailing end of the sheet 25 runs through the gap between the printing cylinder 7 and the blanket cylinder 6, both cylinders are separated to form gap 60 (FIGS. 1, 3) so that no ink can be transferred from blanket cylinder 6 which carries the prime printing to the impression cylinder 7 which carries the verso printing information.

FIG. 3 illustrates the position of all elements after rotation of 720 degrees, starting from a position in accordance with FIG. 1. The second sheet 31 has been transported to the make-ready table and has reached the supply grippers 21 and is supplied, similarly to the sheet 25, to the printing station.

The number of sheets is half that with respect to single sided or prime two-color printing. This reduced number is obtained by causing the suction grippers 17 to pick up a sheet from the stack 19 at only every other reciprocating transport movement thereof, since they are only connected to a vacuum source 20 during every second reciprocating operation. After having picked up a sheet, the suction grippers 17 reciprocate idly, that is, no sheet is carried along from the stack, since the suction grippers are not connected to a suction source.

EMBODIMENT OF FIGS. 7-9

The double printing station 14 is adapted for cooperation with another printing station (not shown) and located in advance thereof, with respect to flow of printed material. The entire printing machine must be supplied with a sheet supply device which permits supply of sheets, selectively, for each rotation of the cylinders or only every other rotation thereof. A suitable sheet supply apparatus is the apparatus 2 of FIG. 1.

The dual printing station 40 has two plate cylinders 41, 42, two blanket cylinders 43, 44, and an impression cylinder 45. All cylinders have the same diameter. The impression cylinder 45, like cylinder 7, has a rubber blanket applied thereover for transfer of printed information thereto, and subsequent thereof to a sheet of paper. A sprocket wheel is connected at each one of the ends of the blanket cylinder 44—not shown—to guide a chain 46. Chain 46 has grippers attached thereto, in accordance with well known and suitable construction. The inkers and dampers associated with the plate cylinders 41 and 42 have been omitted from the drawing for clarity.

A chain 47, supplied with grippers (not shown), supplies sheets to the dual printing apparatus 40. Chain 47 is guided over sprocket wheels 48. An engagement element is provided, formed as an engagement pressure roller 49. Pressure roller 49 is so journaled in the side walls of the machine that, selectively, it can be engaged at the circumference of the impression cylinder 45 or separated therefrom. Separation is indicated by the gap line 490, FIG. 8. Blanket cylinders 43, 44 are located for pivoting or rocking movement about the circumference of the plate cylinder 41, 42 so that they can be selectively engaged with the impression or printing cylinder 45, while maintaining contact with the plate cylinders 41, 42 associated therewith. When separated, the separating gaps are shown at 430 and 440, FIGS. 7 and 9. The positioning elements may be rocking levers, eccenters or the like, hydraulically or mechanically controlled, for example.

A control unit C' is provided which controls the positioning of the cylinders 43, 44 and of roller 49, control unit C' having the required output terminals C43, C44, C49.

OPERATION

At the instant of time in which the grippers of the impression cylinder 45 receive a sheet from the grippers of the chain 47, the engagement roller 49 is spaced from the impression cylinder 45—see gap 490, FIG. 8. As the impression cylinder 45 rotates, the leading edge of the sheet will reach the gap to the engagement roller 49, and the control unit C' will supply an output over output terminal C49 to move the center of rotation of the engagement roller 49 to engage the thus-supplied sheet against the impression cylinder for the duration of the sheet passage phase. As soon as the leading edge of the sheet 50 reaches the gap between the blanket cylinder 43 and the impression cylinder 45, see FIG. 7, the blanket cylinder 43 is moved out of contact from the impression cylinder 45 by a suitable output signal from terminal C43. See gap 430, FIG. 7. No more ink can be transferred from the blanket cylinder 43 to the impression cylinder 45 subsequent thereto. When the leading edge of the sheet reaches the gap between the blanket cylinder 44 and the impression cylinder 45, the previously existing gap 440 is cancelled and the blanket cylinder 44 is engaged with the impression cylinder. During the then following sheet passage phase, prime and verso printing between cylinders 44, 45 will result.

When the end of the sheet 50 runs beneath the engagement roller 49, the engagement roller 49 is lifted off on the command of the control unit C' to reestablish the gap 490, FIG. 8. Thus, no further remnants of ink can be transferred from the ink receiving blanket on the impression cylinder 45 to the engagement roller 49. As the trailing end of the sheet passes through the gap between the blanket cylinder 43 and the impression cylinder 45, a command from terminal C43 of the control unit C' engages the blanket cylinder 43 with the impression cylinder to transfer printing information to the blanket on the impression cylinder 45. The impression cylinder 45, thus, can receive a new printed image. Engagement between the blanket cylinder 43 and the impression cylinder 45 will be for the duration of the next following idle or non-printing phase. The position of the elements at this condition is shown in FIG. 8.

The leading edge of the sheet is removed by chain 46 in direction of the arrow c, see FIG. 8. As soon as the end of the sheet being removed by the chain 46 leaves the gap between blanket cylinder 44 and impression cylinder 45, blanket cylinder 44 is separated from the impression cylinder 45 and returned to the position shown in FIG. 9, to establish the gap 440 therebetween. The blanket cylinder 44 rotates, but the space from the impression cylinder 45. Subsequently, a further sheet 51 is introduced into the printing system 40, and the cycle will repeat.

The printing station 40, of course, can be used alternatively to provide prime two-color printing, in accordance with well known printing and threading arrangement.

The printing machine, constructed and arranged in accordance with the present invention, further provides the possibility to permit double inking of the rubber blanket cylinders when used for single, or prime multicolor printing. It is necessary to change the sheet supply unit 2 to supply a sheet only for every other revolution, that is, to adjust the sheet supply for prime and verso printing. The control unit C, C' respectively, however, is changed to control the respective rubber and blanket cylinders as for prime printing only. For example, the machine in accordance with FIGS. 1 to 3 is so controlled that the blanket cylinders 5 and 6 are in engagement with the impression cylinder, as explained in the operating mode for prime and verso printing with respect to the blanket cylinder 6, during the sheet passage phase; during the subsequent freewheeling phase, however, both the blanket cylinders 5 and 6 are separated from the impression cylinders, that is, the gaps 50, 60 are both established. Since the cylinders rotate between two sequential sheets by 720°, the rubber cylinders 5, 6 will be inked twice for each sheet. The printing system 40, FIG. 7–9, can be operated similarly. Double inking has the advantage of particularly good ink saturation of the printed subject matter.

Various changes and modifications may be made, and features described in connection with any one of the embodiments may be used with the other, within the scope of the inventive concept. For example, a sheet supply apparatus can be used which operates at only half the operating speed when commanded to supply sheets only for every other operating revolution of the printing cylinders, that is, in the adjustment for both prime and verso printing with respect to the supply of sheets for multi-color prime printing only.

I claim:

1. Method of printing in prime and verso printing mode on a substrate sheet by a printing machine having
   - two plate cylinders (3,4; 41, 42);
   - two rubber blanket cylinders (5, 6; 43, 44) in continuous surface engagement with an associated respective plate cylinder;
   - a printing or impression cylinder (7, 45) carrying a rubber blanket capable of receiving printing information,
   - all said cylinders having essentially the same diameter comprising: controlling, respectively, engagement and disengagement of said rubber blanket cylinders and the impression cylinder by
     - (a) separating one (5) of the rubber blanket cylinders and the impression cylinder (7,45) during a first or printing phase of revolution of the impression cylinder while engaging a substrate sheet against the impression cylinder;
     - (a1) engaging said rubber blanket cylinder with the rubber blanket of the impression cylinder for transferring of printed information from the rubber blanket cylinder to the rubber blanket of the impression cylinder during a second phase of operation and when no substrate sheet is positioned between the rubber blanket cylinder and the impression cylinder to effect verso printing on said substrate sheet;

(a2) transferring printing information from the rubber blanket cylinder to the rubber surface of the impression cylinder by engagement of said rubber blanket cylinder (5, 43) with the impression cylinder (7, 45) during a second, or non-printing operating phase of the machine;

(b) engaging the other (6, 44) rubber blanket cylinder against the printing or impression cylinder (7, 45) with the substrate sheet therebetween for prime printing on said substrate sheet during said first operating phase;

(b1) separating the other rubber blanket cylinder (6, 44) from the printing or impression cylinder (7, 45) during said second operating phase to prevent ink smear by the second rubber blanket cylinder on the printing information transferred to the rubber surface of the impression cylinder by the first rubber blanket cylinder (5,43).

2. Method of printing according to claim 1, wherein said engaging step comprises applying a roller (23, 24) against the surface of the impression cylinder, with a substrate sheet therebetween.

3. Method of printing according to claim 1, wherein said engaging step comprises blowing compressed air against the surface of the printing or impression cylinder, with the substrate sheet placed against said printing or impression cylinder, the compressed air pushing said substrate sheet against the surface of the printing or impression cylinder.

4. Method of printing according to claim 1, including the step of positively engaging the substrate sheet against the printing or impression cylinder during the said first, or printing phase of operation of the machine.

5. Method of printing according to claim 1, further including the step of feeding substrate sheets to said machine in intermittent steps, for said first phase only whereby the sheets will be fed to the machine for alternate operating phases of the machine.

6. Method of printing according to claim 1, wherein said controlling step further comprises separating both said rubber cylinders (5, 6) during alternate revolutions of the cylinders, and engaging both said rubber cylinders with the impression cylinders, while feeding a sheet to the machine when the rubber blanket cylinders are engaged with the impression cylinders to provide for double inking of the rubber cylinders during the operating phase when both said rubber blanket cylinders are separated from the impression cylinder.

7. Sheet-fed rotary offset printing machine system having a sheet supply apparatus (2);

at least two plate cylinders (3, 4; 41, 42);

at least two rubber blanket cylinders (5, 6; 43, 44) in continuous surface engagement with an associated respective plate cylinder;

a printing, or impression cylinder (7, 45), all said cylinders having essentially the same diameter;

and means for selectively printing in single side, or prime, multi color mode, or prime and verso printing mode comprising, in accordance with the invention speed selection means (15) coupled to and selectively controlling the speed of sheet delivery of the sheet supply apparatus (2) in two different speed ranges to supply sheets at a first predetermined rate for single side prime printing and at half said first predetermined rate for prime-and-verso printing;

engagement means (23, 24) positioned between the sheet supply apparatus and the printing or impression cylinder (7, 45) positioned for engagement of a sheet against the printing or impression cylinder;

a rubber blanket positioned on the surface of the printing or impression cylinder;

and position control means (C) connected to and controlling the relative position of the rubber blanket cylinder, impression cylinder, and engagement means, in intermittent operation (a) for separation of one (5, 43) of the rubber blanket cylinders and the printing or impression cylinder (7, 43) during a first or printing operating phase during which printing information is transferred from the rubber blanket on the printing or impression cylinder to a sheet in engagement therewith;

(a') for engagement of said one (5,43) of the rubber blanket cylinders with the impression cylinder (7, 45) for transfer of printing information from said rubber blanket cylinder to the rubber blanket of the impression cylinder during a second, or non-printing or idling operating phase;

(b) for engagement of the other rubber blanket cylinder (6, 44) with the printing or impression cylinder (7, 43) for prime printing during said first operating phase; and (b') for separating the other rubber blanket cylinder (6, 44) from the printing or impression cylinder (7, 43) during said second operating phase.

8. System according to claim 7, wherein said position control means (C) is further connected to and controls the relative position of said engagement means (23, 24, 28) to engage a sheet with the printing or impression cylinder during said first operating phase.

9. System according to claim 7, wherein the engagement means comprises an engagement roller (23).

10. System according to claim 9, wherein the engagement roller is of slightly double-conical shape with the center portion thereof having a diameter slightly greater than the diameter of the end portions.

11. System according to claim 7, where said engagement means comprises a rotating, circular brush (24).

12. System according to claim 9 or 11, wherein said engagement means is driven at a circumferential speed less than the circumferential speed of the printing, or impression cylinder (7, 43).

13. System according to claim 7, wherein said engagement means comprises a compressed air duct (28) having air projecting nozzles (29) directing compressed air towards the printing or impression cylinders (7, 43).

14. System according to claim 13, wherein said compressed air duct comprises a tube extending essentially parallel to the printing or impression cylinder, and supplied with compressed air, said tube having air projecting nozzles (29) directed towards the surface of the printing or impression cylinder.

15. System according to claim 7, wherein the rubber blanket cylinders are secured in the machine in bearings which are movably positioned therein, and the control unit (C) is connected to and controls the relative position of said bearings of the rubber cylinders (5, 6) with respect to the printing or impression cylinders.

16. System according to claim 7, where said sheet selection means of the sheet delivery apparatus (2) and the control units (C) are coupled to supply one sheet from a stack (19) for every two revolutions of the respective cylinders.

17. System according to claim 7, where said sheet selection means of the sheet delivery apparatus (2) and the control units (C) are coupled to supply one sheet from a stack (19) for every two revolutions of the respective cylinders;

and wherein said position control means (C) additionally controls the relative position of the rubber blanket cylinders and the impression cylinder to engage the rubber blanket cylinders and the impression cylinder during said first phase and to separate both rubber blanket cylinders and the impression cylinder (7) during the second phase to permit double-inking of the rubber blanket cylinder for single-sided prime printing by the machine.

* * * * *